US009867435B2

(12) United States Patent
Lepore et al.

(10) Patent No.: US 9,867,435 B2
(45) Date of Patent: Jan. 16, 2018

(54) WATCH WITH EXTENDING WATCHBAND

(71) Applicant: Swatch AG, Biel/Bienne (CH)

(72) Inventors: Olivia Lepore, Bern (CH); Matthias Zaeh, Adliswel (CH)

(73) Assignee: Swatch AG, Biel/Bienne (CH)

( * ) Notice: Subject to any disclaimer, the term of this patent is extended or adjusted under 35 U.S.C. 154(b) by 66 days.

(21) Appl. No.: 15/019,534

(22) Filed: Feb. 9, 2016

(65) Prior Publication Data

US 2016/0242516 A1 Aug. 25, 2016

(30) Foreign Application Priority Data

Feb. 20, 2015 (EP) ..... 15155950

(51) Int. Cl.

| | |
|---|---|
| ***A44C 5/14*** | (2006.01) |
| ***A44C 5/20*** | (2006.01) |
| ***A44C 5/00*** | (2006.01) |
| ***G04B 37/14*** | (2006.01) |

(52) U.S. Cl.

CPC ..... *A44C 5/2071* (2013.01); *A44C 5/0069* (2013.01); *A44C 5/147* (2013.01); *G04B 37/1486* (2013.01)

(58) Field of Classification Search

CPC .... G04B 37/1486; G04B 37/16; G04B 37/18; A44C 5/0069; A44C 5/147; A44C 5/142; A44C 5/14; A44C 5/2071; A44C 5/2066; A44C 5/2076; A44C 5/22; A44C 5/0053; A44C 5/2085

USPC ..... 224/164–180; 368/281–283; 24/265 WS, 24/906

See application file for complete search history.

(56) References Cited

U.S. PATENT DOCUMENTS

| | | | | |
|---|---|---|---|---|
| 2,512,992 A | | 6/1950 | Barre | |
| 3,700,148 A | * | 10/1972 | Lanvin | A44C 5/00 224/170 |
| 4,377,872 A | * | 3/1983 | Daniell, Jr. | A41F 9/002 2/321 |
| 5,014,040 A | * | 5/1991 | Weaver | A44C 5/14 340/539.1 |

(Continued)

FOREIGN PATENT DOCUMENTS

| | | |
|---|---|---|
| AT | 509 063 A4 | 6/2011 |
| CH | 706 163 A2 | 8/2013 |
| EP | 1 898 278 A1 | 3/2008 |

(Continued)

OTHER PUBLICATIONS

Azom.com, last visited Sep. 3, 2014 via the Wayback Machine Internet Archive.*

(Continued)

*Primary Examiner* — Scott McNurlen

(74) *Attorney, Agent, or Firm* — Oblon, McClelland, Maier & Neustadt, L.L.P.

(57) ABSTRACT

Watch comprising a watchband fixed to a case, this watchband comprising an extending strand, and a buckle arranged to encircle a case or an element protruding from this watchband, formed by this extending strand or by an added buckle, and the buckle comprises a stop surface arranged to cooperate, in a fastened position, either with a first complementary stop surface of a case, or with a second complementary stop surface comprised in the protruding element of the watchband.

16 Claims, 7 Drawing Sheets

(56) References Cited

U.S. PATENT DOCUMENTS

| | | | | |
|---|---|---|---|---|
| 2008/0062822 | A1 | 3/2008 | Barbier | |
| 2010/0177604 | A1* | 7/2010 | Ginter | A44C 5/0015 368/282 |

FOREIGN PATENT DOCUMENTS

| | | | | | |
|---|---|---|---|---|---|
| FR | 3 004 898 | A1 | | 10/2014 | |
| JP | 56057978 | A | * | 5/1981 | G04B 37/1486 |
| JP | 2003250612 | A | * | 9/2003 | A44C 5/147 |

OTHER PUBLICATIONS

English Translation of JP2003250612, provided by Espacenet.com.*

European Search Report dated Aug. 25, 2015 in European Application 15155950.7 filed on Feb. 20, 2015 (with English translation).

* cited by examiner

WATCH WITH EXTENDING WATCHBAND

This application claims priority from European Patent application No. 15155950.7 filed Feb. 20, 2015, the entire disclosure of which is hereby incorporated herein by reference.

FIELD OF THE INVENTION

The invention concerns a watchband comprising, between first and second opposite ends, at least one extending strand.

The invention also concerns a watch including a watchband of this type attached to a case.

The invention concerns the field of devices secured to the human body, in particular time measuring devices, such as watches, or scientific devices such as radioactivity recorders or suchlike, and the field of jewellery bracelets or fashion items.

BACKGROUND OF THE INVENTION

Bracelets, and especially watchbands, generally have dimensions adjusted to the morphology of the user. Ranges of adjustment are limited. Few bracelets or watchbands are capable of being slipped on or off quickly, while providing a good fit and secure hold during use and wear.

Conventional clasps require delicate handling, whether they use buckles with tongues or deployant buckle mechanisms. In particular, they are impossible to operate wearing gloves. Moreover, these clasps are also expensive and generally comprise injurious protruding parts.

Bracelets or watchbands made entirely of resilient material do not always provide good performance, particularly when the user, for example a sportsman, subjects the watch or watchband to high accelerations.

The patent application FR 3 004 898 A1 DAVINSY describes a watchband including a buckle with two clamping arms linked together and able to encircle the watchcase.

The patent application U.S. Pat. No. 2,512,992 A BARRE Robert describes a watchband including an end buckle arranged to entirely surround a watchcase, and arranged to cooperate on one side inserted in a groove of the watchcase, and to cooperate on an opposed side clipped with a projection of the watchcase.

SUMMARY OF THE INVENTION

The invention proposes to develop a watchband, more particularly a watchband, which has no clasp in the usual sense of the term, which has a wide range of adjustment, is easy for the user to slip on and off, and is suitable for professional or sporting use.

BRIEF DESCRIPTION OF THE DRAWINGS

Other features and advantages of the invention will appear upon reading the following detailed description, with reference to the annexed drawings, in which:

FIG. 15 is an exploded perspective view.

FIG. 16 is an assembled perspective view, with the buckle in a stopped position on the watch case.

FIG. 17 is a front view in the same position.

FIG. 18 is view from the right.

FIG. 19 is a top view.

FIG. 20 is a cross-section along the plane AA of FIG. 18.

DETAILED DESCRIPTION OF PREFERRED EMBODIMENTS

Figure 1:
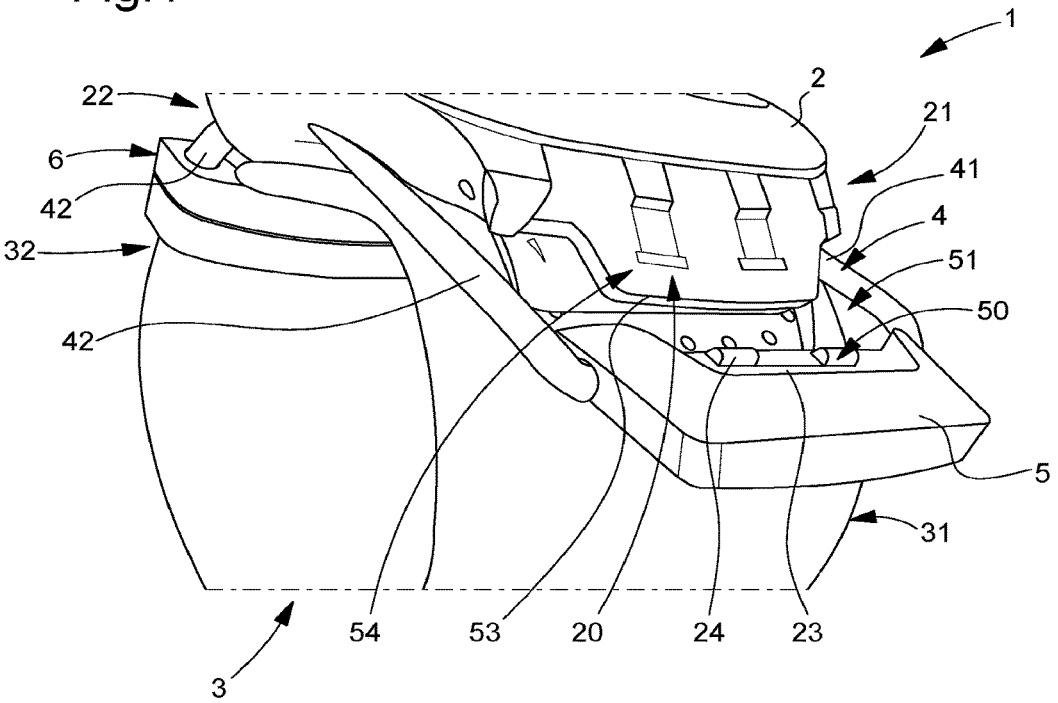
FIG. 1 shows a schematic perspective view of a watch according to the invention, comprising a watchband according to the invention, equipped with a resilient extending strand split either side of the watch case, and including a buckle, which engages on one side of the watch case, and includes stop surfaces in relief cooperating with complementary stop surfaces in counter relief of the watch case, these reliefs and counter reliefs being also devised to ensure a clip-fit in a fastened position, the extending strand being shown in a position of maximum elongation, either before the buckle is placed in its housing in the case, or, conversely, when the watch is removed by the user.
Figure 2:
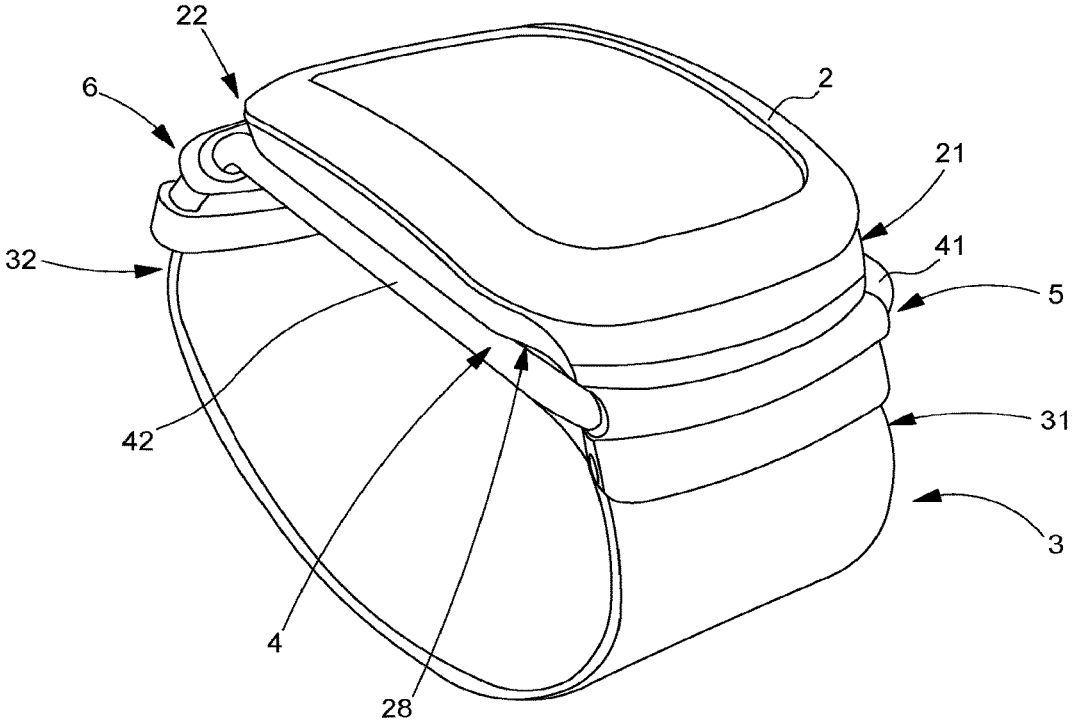
FIG. 2 shows a schematic perspective view of a watch according to the invention, comprising a watchband according to the invention, equipped with a resilient extending strand split either side of the watch case and including a buckle, which engages directly on one side of the watch case, in a through slot in which the buckle is immobilised, shown here in the fastened position in which the watch is worn.
Figure 3:
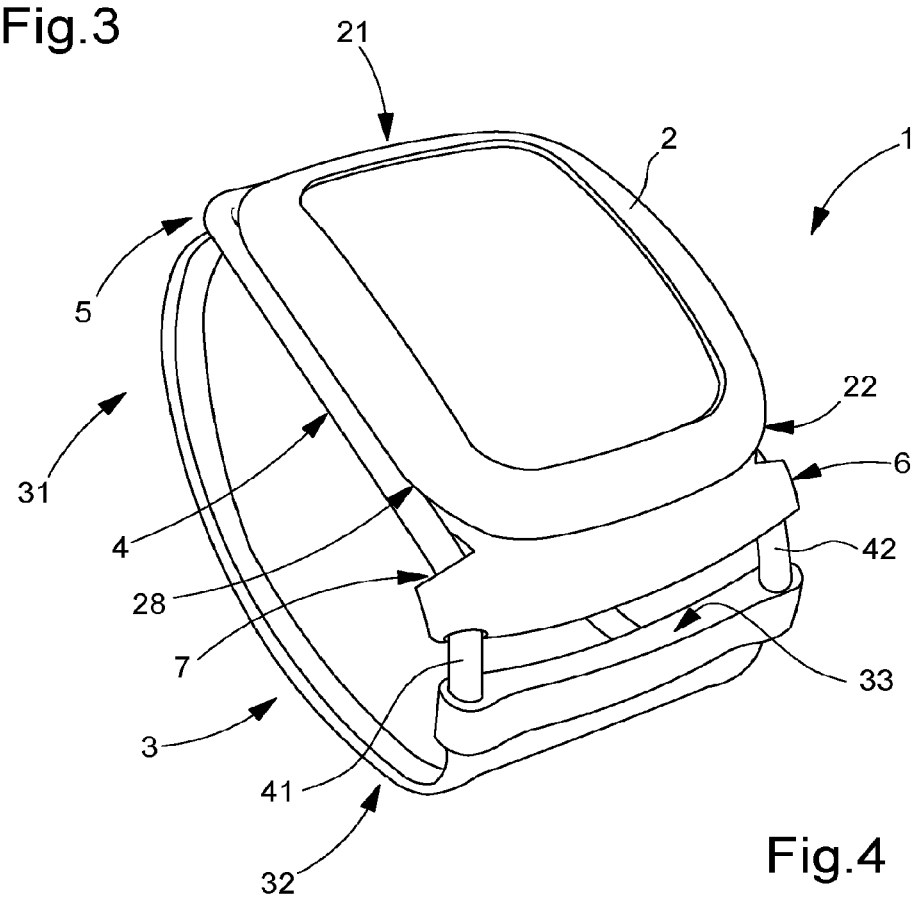
FIG. 3 shows, in a similar manner to FIG. 2, the same watch, seen from the other side of the case, where there is shown a guide bar for the lateral resilient strands, integral with the watch case.
Figure 4:
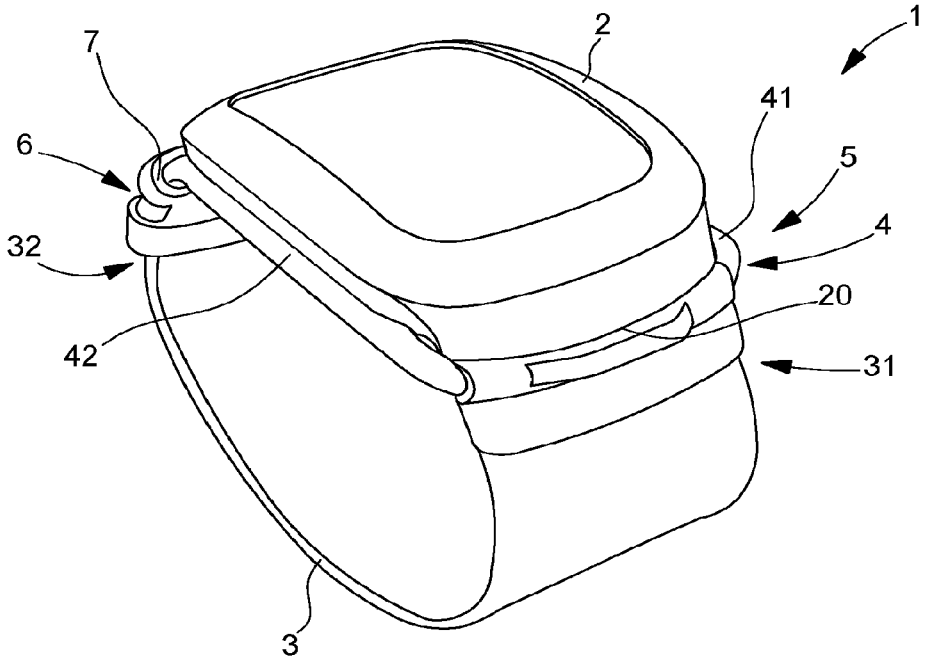
FIGS. 4 and 5 show, in a similar manner to FIGS. 2 and 3, a variant wherein the buckle includes a sheath provided with a gripping tab for convenient handling, in particular during removal.
Figure 5:
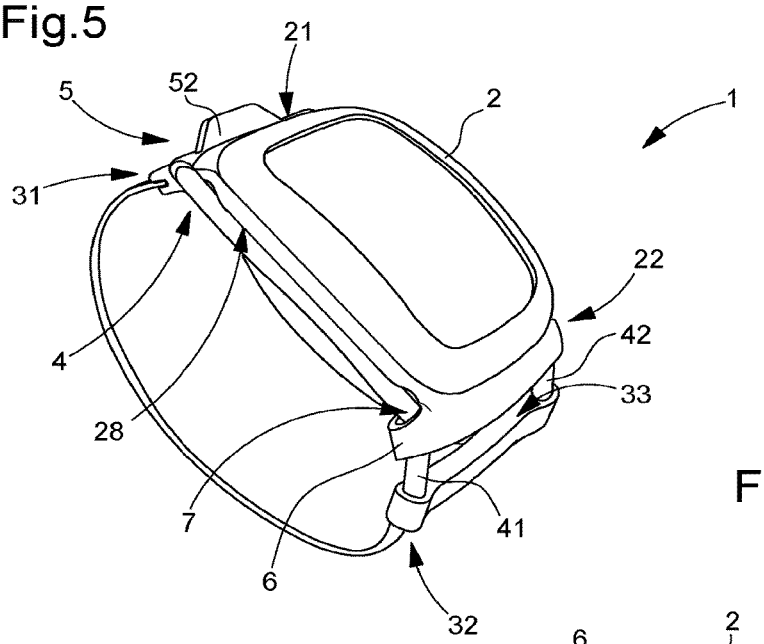
Figure 6:
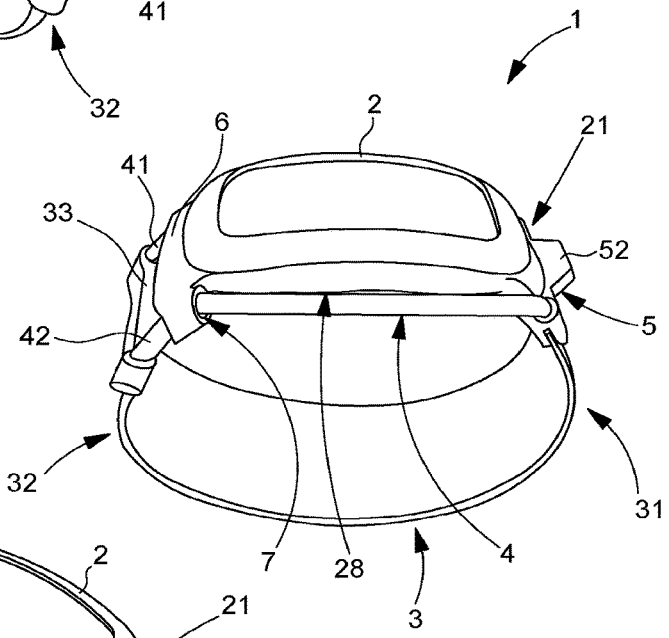
FIG. 6 is another view of the same watch.
Figure 7:
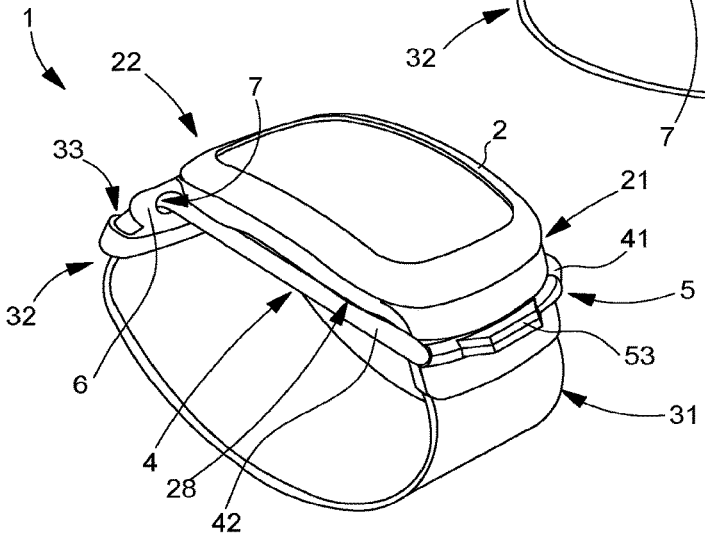
FIG. 7 shows, in a similar manner to FIG. 2, another variant wherein the buckle includes a clamp provided with operating fingers also forming together a gripping tab.
Figure 8:
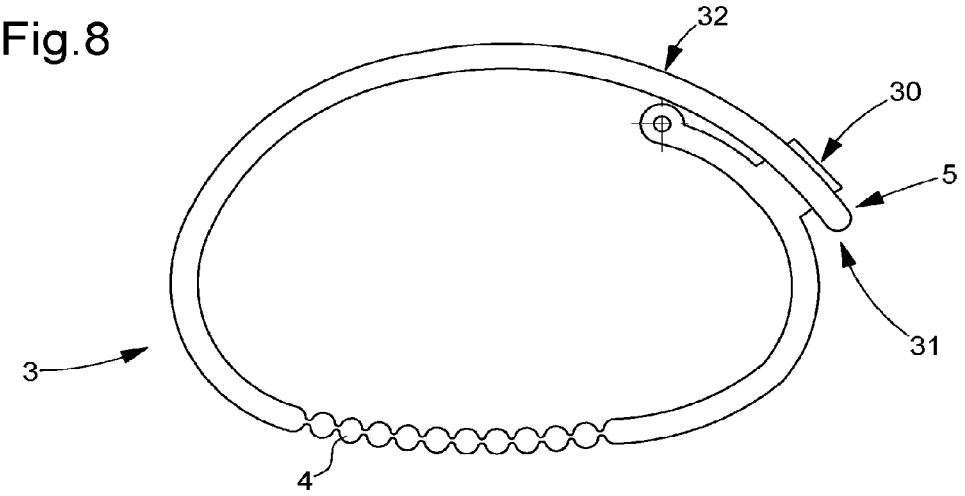
FIGS. 8 and 9 show schematic front and top views of a watchband according to the invention, comprising an intermediate extending strand between two rigid parts, one of which carries a protruding element which is fastened to a buckle comprised in the opposing part.
Figure 9:
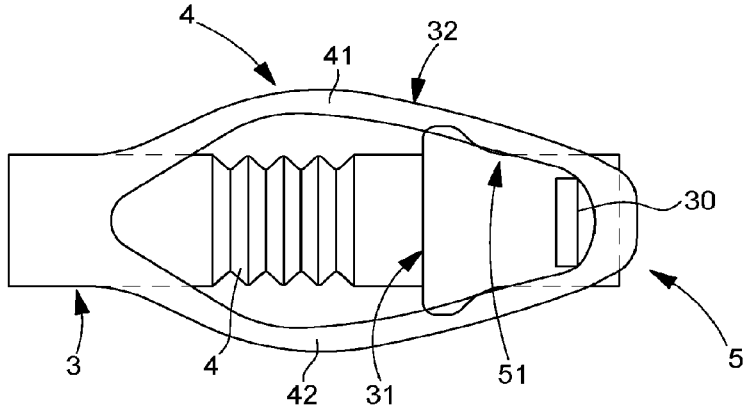
Figure 10:
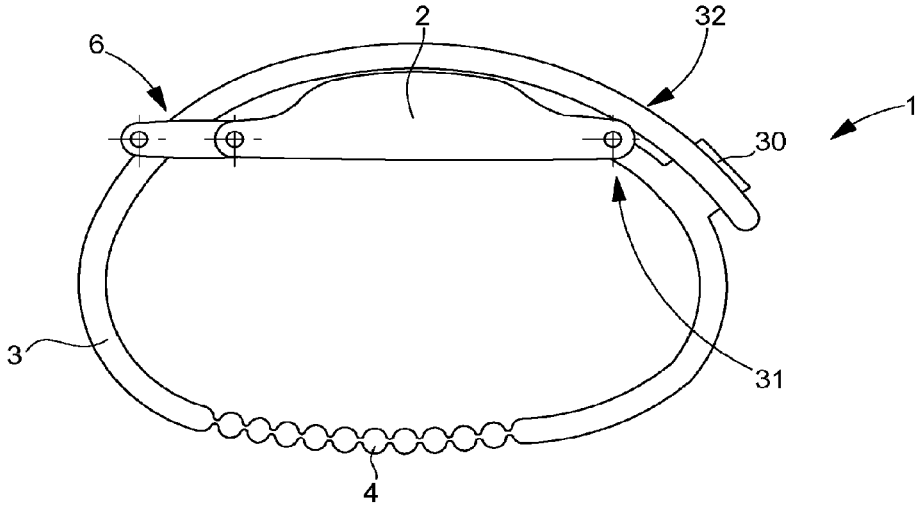
FIG. 10 shows a schematic front view of a variant of the watchband of FIGS. 8 and 9, to which there is hinged a watch case on a first side, which carries on the other side a hinged link used as a guide for the part of the watchband forming a buckle, the extending strands pass here above the watch case.
Figure 11:
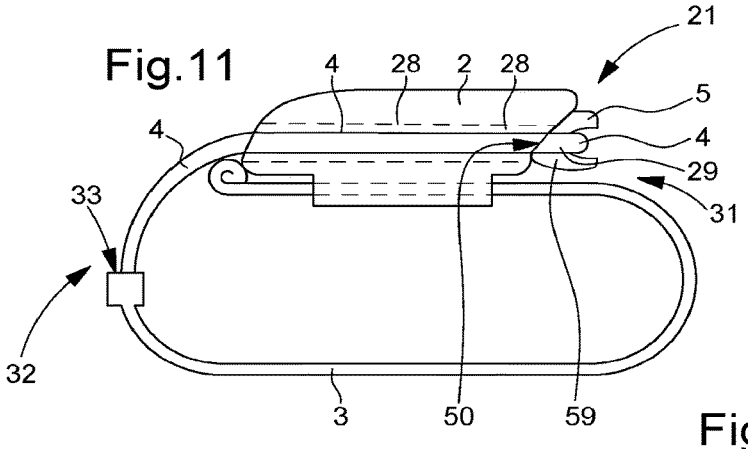
FIGS. 11 and 12 show schematic front and top views of a watch according to the invention, comprising an extending end strand whose buckle is accommodated in a groove of an added buckle which is locked on a face of the watch case having a back taper, the lateral strands being held on the side of the watch case in longitudinal grooves comprised therein.
Figure 12:
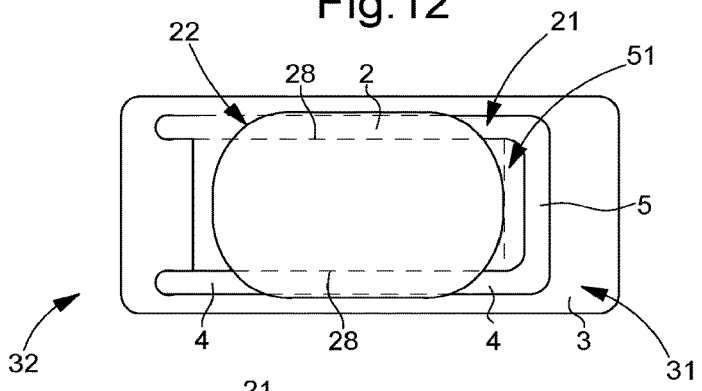
Figure 13:
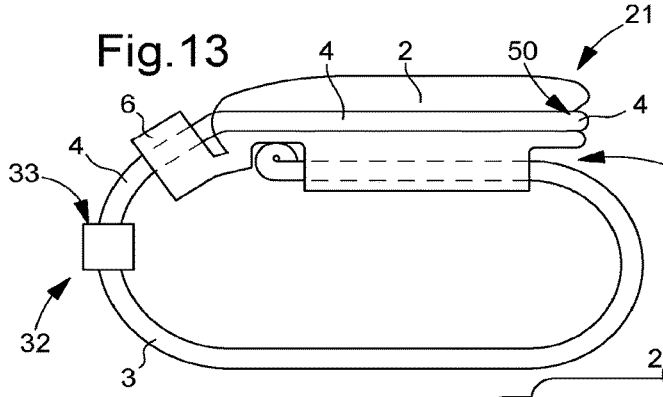
FIGS. 13 and 14 show schematic face and top views of a watch according to the variant of FIG. 2. As in the variant of FIGS. 11 and 12, one end of the watchband is fixed to the watch case which forms a loop on the lower face thereof, and a fold of the watchband is immobilised at one end of the loop, so as to oppose the traction force of the extending strand when the watchband is lengthened.
Figure 14:
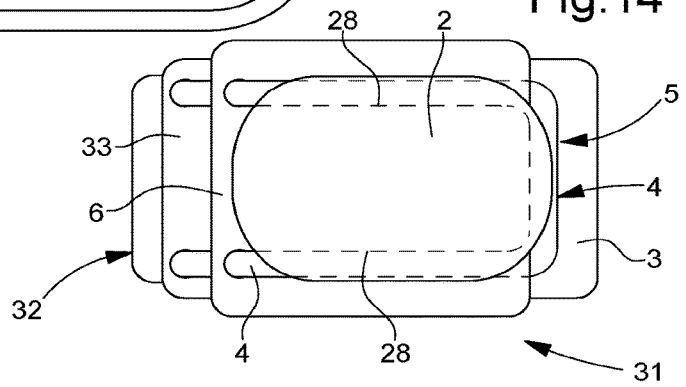
Figure 15:
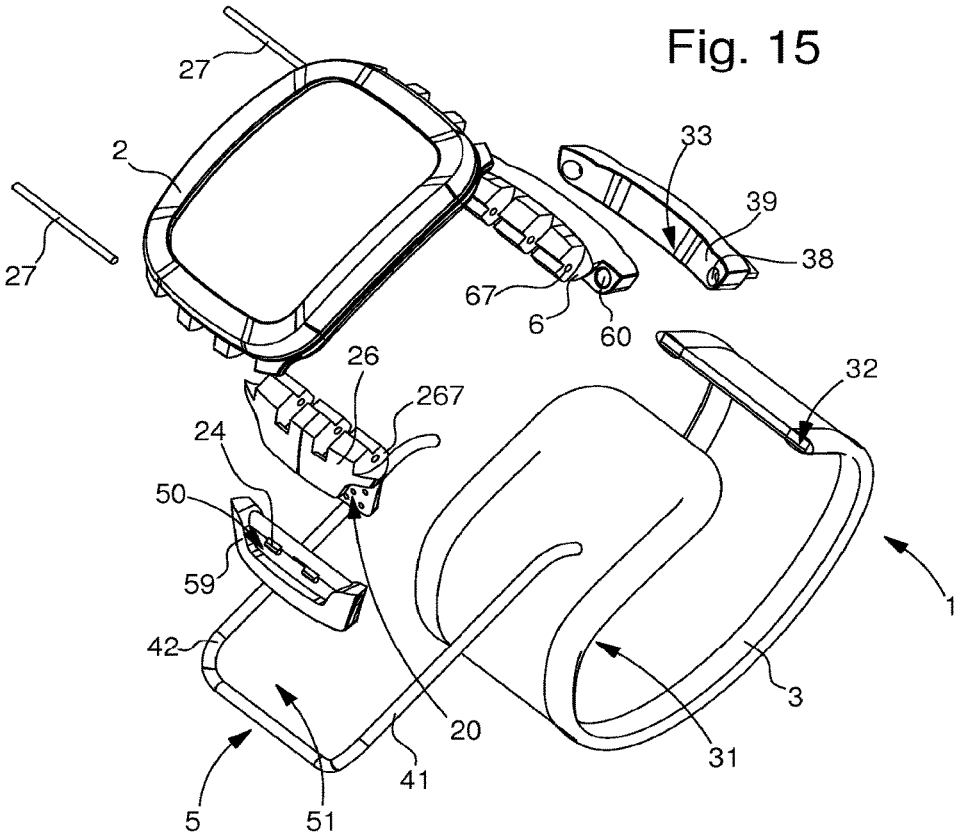
FIGS. 15 to 20 illustrate a particular variant of the invention, with an extending end strand forming a buckle with an added buckle, which cooperates with an insert hinged to the watch case, whereas at the other end the watchband carries a bar for securing the extending strand, which is guided by a guide member also hinged to the watch case.
Figure 16:
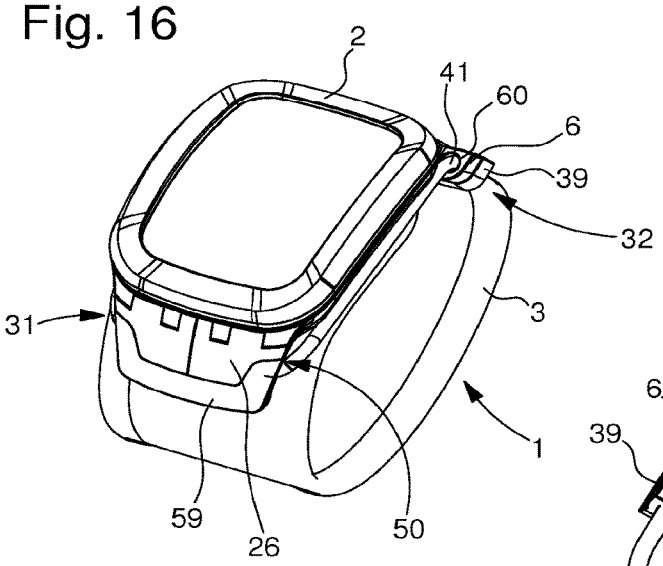

The invention consists in arranging a watchband so that a buckle comprised in the watchband can be placed above a protruding element comprised in the watchband or an element carried thereby, such as a watch case, and exert a traction force to securely hold the assembly when the user wears the assembly on his or her wrist.

More specifically, in a preferred application, the invention consists in arranging a watchband such that a buckle, comprised in the watchband, can be placed atop the watch case to abut on a protruding element, and in particular on one side of the case, and exert a traction force to hold the watch case securely when the user wears the assembly on his or her wrist.

To this end, the watchband includes at least one extending strand, and a buckle which may, in different variants, be either a deformable element such as an extending strand, or a non-deformable element, such as a rigid bar or similar element, which may then be carried either by an extending strand or by a non-extending part of the watchband.

Naturally, it is possible to combine abutment of the buckle on a watch case and abutment on a protruding element of the watchband so that the traction force can be adjusted. Similarly, several separate protruding elements can be provided to allow the user to choose the one that provides the desired traction force; it is also possible to define several possible surfaces for receiving the buckle on a watch case. It will also be mentioned that it is possible to use a buckle comprising several abutment surfaces, capable of abutting engagement with the same surface of the case, or with the same protruding element of the watchband.

The invention is described below in a simplified embodiment, wherein a single abutment surface of the buckle cooperates with a single surface of a watch case or of the watchband, depending on the case. The invention is described in succession for a watchband alone, and for a watch equipped with a watchband. Naturally, the features of one application can be transposed to the other.

The invention also concerns a watchband 3 which comprises, between a first end 31 and a second end 32, at least one extending strand 4.

In the illustrated variants, watchband 3 includes at least one other strand, which is less extendable than said at least one extending strand 4. Strand 4 is thus more extendable than any other said watchband strand 3.

In some variants, at least one said other strand is not extendable, i.e. this other strand is of invariable length (with the exception of ordinary expansion and play between the links or weave in the case of a textile watchband) under the action of a traction force imparted by the user. This other strand may however be flexible, and made in a conventional manner of leather, plastic material, metal or suchlike.

Watchband 3 comprises, at second end 32 opposite first end 31, a buckle 5 which comprises at least one stop surface 50 arranged to cooperate, in a fastening position, either with at least a first complementary stop surface 20 of a case 2 assembled to watchband 3 at the first end 31 thereof, or with a second complementary stop surface 30 comprised in watchband 3 in proximity to the first end 31 thereof. This buckle 5 includes, if it is rigid, or forms if it is flexible, a recess 51 which is arranged to surround a protruding portion comprised in watchband 3 and which forms second complementary stop surface 30.

Buckle 5 may take different forms, for example, a simple hook in an L-shape, a U-shape or an O-shape. The essential point is that stop surface 50 is securely held in the operating position.

Preferably, extending strand 4 is sized to provide a traction force greater than 2N on buckle 5 for any diameter of the user's wrist comprised between a given minimum diameter DMIN and maximum diameter DMAX.

In a variant, second complementary stop surface 30 includes at least a first housing 23 and/or a first lug 24 arranged to cooperate in a complementary manner with a second lug 53 and/or a second housing 54 comprised in stop surface 50 of buckle 5.

In a variant, at least one stop surface 50 is arranged to cooperate in a clip-fit, in the fastening position, with at least a second complementary stop surface 30.

In a variant, buckle 5 comprises gripping means 52 arranged to facilitate the extraction of buckle 5 when said watchband 3 is extended for removal.

In a variant, buckle 5 comprises resilient actuating means 53 forming a clamp arranged to improve the fastening of buckle 5 on the complementary stop surface and/or to facilitate the extraction of buckle 5 when watchband 3 is extended for removal.

In a variant, watchband 3 includes at least one hinged link carrying a second complementary stop surface 30.

In a variant, at least one extending strand 4 includes at least one resilient strap of substantially circular section, forming, at second end 32 of watchband 3, two strands 41, 42 arranged to extend substantially in parallel and joined at the distal end of watchband 3 to form buckle 5.

In a variant, extending end strand 4 forms the entire second end 32 and actually forms buckle 5.

In another variant, second end 32 is rigid and comprises buckle 5 and its recess 51.

In another variant, extending strand 4 may form the entire watchband 3, but this variant proves less practical for quick fastening.

Extending strand 4 may be made in different manners. In a preferred variant illustrated by the Figures, extending strand 4 is resilient, and can be made in a resilient material such as rubber or similar, or in the form of a spring or pleat, or another form.

In another variant not illustrated in the Figures, extending strand 4 is in the form of a combination of elements that slide in relation to each other, retained in relation to each other by friction or suchlike, these elements being combined with an elastic return means, such as a spring, arranged to exert the required traction force, or preferably with a cam mechanism which, when rotated, exerts the corresponding force.

The invention more specifically concerns a watch 1 comprising, secured to a case 2, one such watchband 3 comprising at least one extending strand 4.

According to the invention, this watchband 3 comprises a buckle 5, which is then arranged to encircle case 2, at least on a first side 21 of case 2. This buckle 5 is formed by an extending strand 4, or by an added buckle 59 secured on an extending strand 4, or by a buckle 59 secured on another part of watchband 3.

This buckle 5 comprises a stop surface 50, which is arranged to cooperate, in at least one fastening position, either with at least a first complementary stop surface 20 of first side 21 of case 2, or with a second complementary stop surface 30 comprised in watchband 3.

Preferably, stop surface 50 and complementary stop surface 20 or 30, as the case may be, are transverse, that is to say substantially perpendicular with respect to a longitudinal direction in which the watchband 3 extends when flat. Naturally, buckle 5 may cooperate with a plurality of surfaces of case 2, or with a boss comprised in watchband 3.

Preferably, extending strand 4 is sized to provide a traction force greater than 2N on buckle 5 for any diameter of the user's wrist comprised between a minimum diameter and a maximum diameter.

Preferably, watchband 3 is fixed to case 2 at a first end 31, and extends from a first side 21 of case 2. In the Figures, the first end 31 is fastened under case 2, between the case and the user's wrist.

Buckle 5 is located at a second end 32 opposite said first end 31. Buckle 5 includes, if it is rigid, or forms of it is flexible, a recess 51 which is arranged to encircle case 2 at least on this first side 21.

In the alternative where buckle 5 is fixed to case 2, first complementary stop surface 20 comprised in case 2 is on its first side 21. In the alternative where buckle 5 is fixed to watchband 3, the second complementary stop surface 30 is in proximity to its first end 31.

Preferably, on first side 21, case 2 comprises a surface 29 having a back taper, forming at least one portion of first complementary stop surface 20. This clearance surface 29 defines an upper edge which is intended to prevent buckle 5 inadvertently leaving the housing that it occupies in its fastened position.

In a specific variant, as seen in particular in FIG. 1, case 2 comprises, on said first side 21, at first complementary stop surface 20, at least a first housing 23 and/or a first lug 24 arranged to cooperate in a complementary manner with a second lug 53 and/or a second housing 54 comprised in stop surface 50 of buckle 5.

In a particular variant, at least one stop surface 50 is arranged to cooperate in a clip-fit, in the fastening position, with at least a first complementary stop surface 20.

In a particular variant, on a second side 22 opposite to first side 21, case 2 comprises guide means 6, which are arranged to guide second end 32 of watchband 3 or at least one extending strand 4, so that case 2 and watchband 3 together form, in any position of buckle 5, a substantially toric closed volume. The user can then very easily slip his hand into this torus-shape, then extend extending strand 4, before fastening buckle 5 to case 2 or to a protruding member 30.

Advantageously, on guide means 6, watch 1 comprises stop means 7 for buckle 5.

In a variant, at least one extending strand 4 slides in guide means 6. Watchband 3 advantageously comprises a stop surface 33, which is arranged to form an end-of-travel stop for guide means 6.

In a variant, buckle 5 includes gripping means 52, which are arranged to facilitate the extraction of buckle 5 when watchband 3 is extended for removal.

In a particular variant, buckle 5 includes resilient actuating means 53 forming a clamp, which are arranged to improve the fastening of buckle 5 on said case 2 and/or to facilitate the extraction of buckle 5 when watchband 3 is extended for removal. For example, buckle 5 includes a resilient split ring comprising a finger on each side of the slot.

For improved retention of buckle 5 in a housing such as a groove, the buckle may comprise a resilient surface coating, such as a rubber sheath or similar, or carry a helical spring of small section, or a split ring, or similar, to forcibly hold the buckle in the groove, in the form of a clipping with substantially axial symmetry Watchband 3 may be made in one piece, or comprise one or more hinged links. In a variant, watchband 3 includes at least one hinged link, which carries a second complementary stop surface 30 for example on a boss.

Similarly, in a variant, case 2 carries guide means 6 on a link, which is hinged on second side 22.

Case 2 may, in fact, either form a one-piece assembly, or be hinged to one or two side links, or comprise such side links which are simply fixed in position by an arbor having the function of a pin, and are very easy to assemble and disassemble.

In a particular variant seen in the Figures, at least one extending strand 4 includes a resilient strap of substantially circular section, forming, at second end 32 of watchband 3, a U-shaped buckle, whose lateral branches are arranged to extend substantially in parallel around case 2 or on case 2 and having a transverse branch that delimits a recess 51 of buckle 5, and is arranged to abuttingly engage with case 2.

Advantageously, case 2 includes at least one longitudinal guide member 28 for receiving extending strand 4 and/or buckle 5. The Figures thus illustrate parallel grooves for receiving two symmetrical parts of an extending strand 4. This guide member also improves the transverse hold of buckle 5 in the fastened position.

In a variant, buckle 5 completely encircles case 2.

FIGS. 15 to 20 illustrate a variant of the invention, which is particularly advantageous due to the excellent hold of buckle 5. The extending end strand 4 forms a buckle 5 with an added buckle 59, which also forms a gripping means 52 to facilitate fastening and removal.

Figure 20:
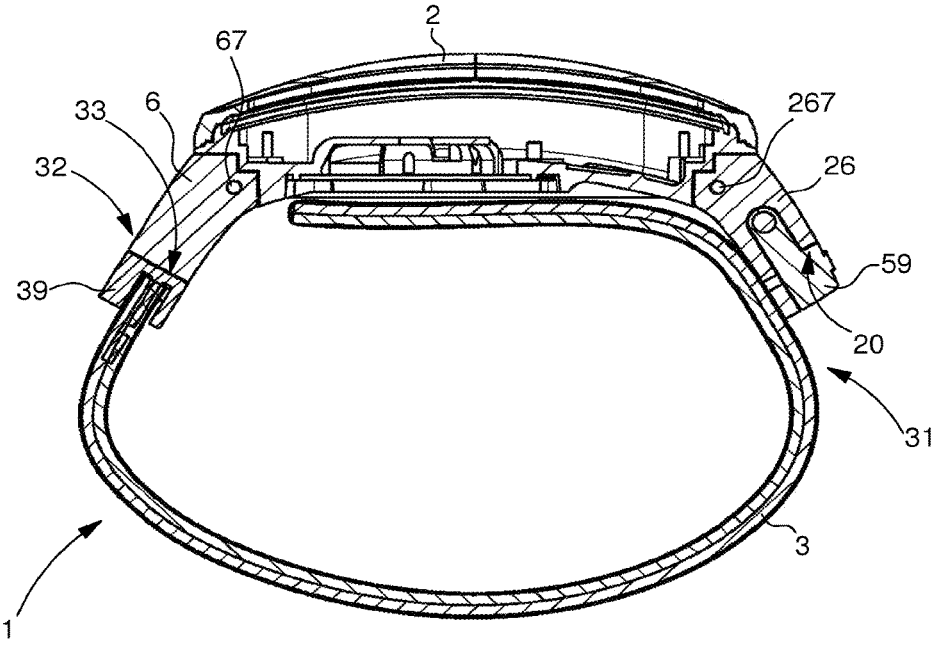

Case 2 includes, on the side of first end 31 of watchband 3, an insert 26, which is fixed and/or hinged by an arbor 27 passing in a bore 267 of insert 26, which has a first complementary stop surface 20, which is arranged to cooperate in a complementary manner with stop surface 50 of added buckle 59. The cross-section of FIG. 20 shows this added buckle thus inserted in insert 26, which forms a V-shaped housing holding buckle 5 perfectly, even under high accelerations.

Case 2 comprises, on the side of second end 32 of watchband 3, a guide 6 which includes bores 60 for guiding the two strands 41, 42 forming extending strand 40. Guide 6 is also fixed and/or hinged by an arbor 27 passing in a bore 67 of guide 6. Watchband 3 carries a bar 39 having housings 38 in which the ends of extending strand 4 are fixed.

In non-illustrated variants, the same buckle 5 may cooperate with several different stop surfaces comprised in case 2 and/or watchband 3, to provide several possible adjustments for the user.

The watch according to the invention is particularly suitable for professional or sporting use. Indeed, there are no injurious parts: the watchband is devoid of any deployant buckle or tongue.

Figure 17:
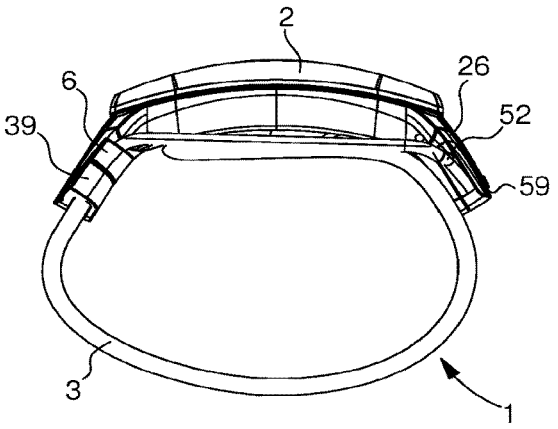
Figure 18:
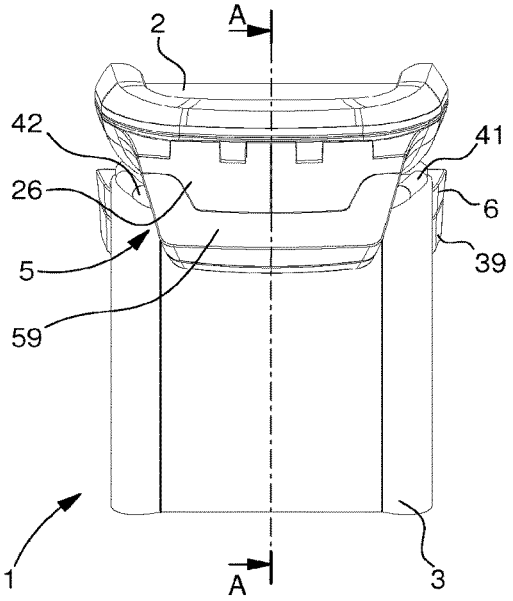
Figure 19:
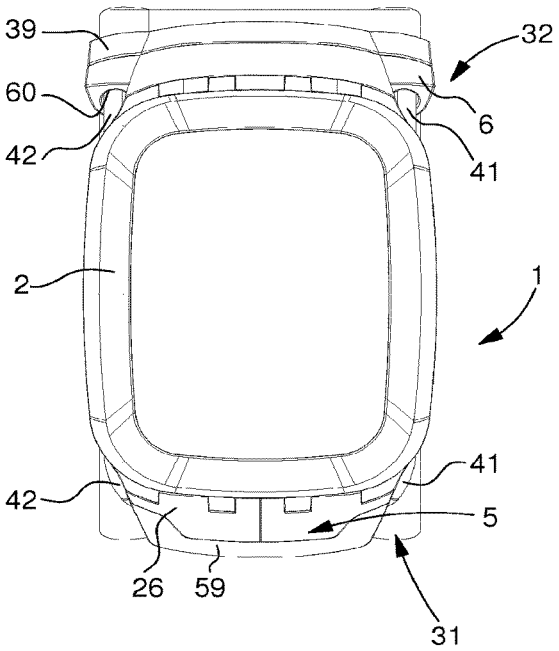

In an advantageous arrangement, as seen in FIG. 17 or 20, watchband 3 includes a strand extending under the watch case, arranged to be in contact with the user's wrist. Preferably, this is a strand named above other strand, that is to say it is not extendable strand. This strand may be bonded underneath the case, or held underneath the case by Velcro, which allows it to be changed quickly.

A shock absorber, such as rubber, may also be inserted between the watchband strand and the back cover of the case.

Preferably, when case 2 contains an electronic apparatus, in particularly a quartz movement and/or a connected watch, any arrangement for securing a watchband strand to the back cover of case 2 comprises a space for the insertion of each battery contained in case 2.

Indeed, in advantageous variants for sport, watchband 3 includes several materials. Preferably, at least one strand is made in an aerated material, allowing the skin to breathe and this material is advantageously washable.

In a particular variant, the watchband includes peripheral and substantially parallel hemmed portions, which each contain, on at least one portion of the periphery of the watchband, a cord having at least one portion that forms extending end strand 4.

Preferably, the surfaces of the watchband facing the user's wrist are all smooth.

In an variant that is advantageous due to constraints in securing the watchband to the case, watch 1 includes a watchband with a non-extendable strand secured to case 2, and an extending strand 4 which extends further, substantially in the extension of the non-extendable strand.

FIGS. 15 to 20 show a preferred configuration of the invention for a watch 1 according to the invention, which still has a substantially toric shape, which the user deforms to slip the watchband on and off: indeed, buckle 5 is held by guide 6 which forms a stop member and prevents any inadvertent removal of the watch The use of a case 2 provided with arbors 27 securing a central case body, and one or more side parts, makes it easy to change the watchband, for aesthetic reasons, or in order to wash the watchband, particularly when it includes at least one textile portion. These arbors 27 may notably be springs, or split rings, which are easy to remove and provide a secure hold in the operating position.

Advantageously, case 2 includes a bezel made of flexible material, providing protection against shocks, in particular with sports accessories: rackets, nets, clubs, balls or suchlike. In a variant, the surface portion of case 2 is entirely made of such a material, such as rubber or similar.

The hold on the wrist is particularly good, even under high accelerations.

The wristband adapts to a large variety of wearer sizes, which makes it versatile. It can be used for work purposes, over a bulky overall or uniform, with no particular adjustment. The wide extension adjustment range of the watchband is therefore advantageous over technical workwear, pressure suits, flight suits, wetsuits or suchlike.

The invention is easy to operate wearing gloves, which may be necessary for safety reasons.

The manufacturing cost is moderate. The invention easily allows the bracelet or watchband to be changed, depending on use or aesthetical considerations.

What is claimed is:

1. A watch comprising:

a case, a watchband secured to the case, wherein said watchband includes at least one extending strand between a first end and a second end opposite to each other and a buckle on said second end, the buckle being arranged to encircle said case at least on a first side of said case, said buckle being formed by said at least one extending strand, and said buckle comprising a stop surface arranged to cooperate, in at least one fastened position, with at least a first complementary stop surface of said first side of said case, wherein said at least one extending strand includes at least one resilient strap forming, on said second end of said watchband, two strands arranged to extend in parallel and joined at a distal end of said watchband to form said buckle, and wherein, on a second side opposite to said first side, said case comprises guide means, which are arranged to guide said second end of said watchband or said at least one extending strand, so that said case and said watchband together form, in any position of said buckle, a closed volume.

2. The watch according to claim 1, wherein said watchband includes at least one other strand in addition to said at least one extending strand, and said at least one extending strand is more extendable than any other said strand.

3. The watch according to claim 2, wherein at least one said other strand is of invariable length under the action of a traction force imparted by the user.

4. The watch according to claim 1, wherein said buckle comprises gripping means arranged to facilitate the extraction of said buckle when said watchband is extended for removal.

5. The watch according to claim 1, wherein said at least one extending strand is sized to provide a traction force greater than 2N on said buckle for any diameter of the user's wrist comprised between a minimum diameter and a maximum diameter.

6. The watch according to claim 1, wherein said watchband is fixed to said case at said first end and extends from said first side of said case.

7. The watch according to claim 1, wherein, on said first side, said case comprises a surface having a back taper forming at least one portion of said first complementary stop surface.

8. The watch according to claim 1, wherein said case comprises, on said first side, on said first complementary stop surface, at least a first housing and/or a first lug arranged to cooperate in a complementary manner with a second lug and/or a second housing comprised in said stop surface.

9. The watch according to claim 1, wherein said watch includes, on said guide means, stop means for said buckle.

10. The watch according to claim 1, wherein at least one said extending strand slides in said guide means, and said watchband includes a stop surface arranged to form an end-of-travel stop for said guide means.

11. The watch according to claim 1, wherein said case carries said guide means on a fixed or hinged link on said second side.

12. The watch according to claim 1, wherein said buckle includes resilient actuating means forming a clamp, arranged to improve the fastening of said buckle on said case and/or to facilitate the extraction of said buckle when said watchband is extended for removal.

13. The watch according to claim 1, wherein said resilient strap has a circular section, and forms, at said second end of said watchband, a U-shaped buckle that includes two lateral branches and one transverse branch, wherein said lateral branches are arranged to extend in parallel around said case or on said case and said transverse branch delimits a recess of said buckle, and is arranged to abuttingly engage with said case.

14. The watch according to claim 1, wherein said case includes at least one longitudinal guide member for receiving said extending strand and/or said buckle.

15. The watch according to claim 1, wherein said buckle entirely encircles said case.

16. A watch comprising:

a case, a watchband secured to the case, wherein said watchband includes at least one extending strand between a first end and a second end opposite to each other and a buckle on said second end, the buckle being arranged to encircle said case at least on a first side of said case, said buckle including at least one resilient strap forming two strands arranged to extend in parallel and joined at a distal end of said watchband, said buckle including an added buckle, and said added buckle, comprising a stop surface arranged to cooperate, in at least one fastened position, with at least a first complementary stop surface of said first side of said case, wherein said case includes, on the side of said first end of said watchband, a fixed or hinged insert, which includes the first complementary stop surface, and which is arranged to cooperate in a complementary manner with said stop surface, and wherein, on a second side opposite to said first side, said case comprises guide means, which are arranged to guide said second end of said watchband or said at least one extending strand, so that said case and said watchband together form, in any position of said buckle, a closed volume.

* * * * *